US005974738A

United States Patent [19]

Jacobs

[11] Patent Number: 5,974,738

[45] Date of Patent: Nov. 2, 1999

[54] TOP GUIDE WITH SPRING LOADED WHEEL

[75] Inventor: Kenneth Jacobs, Surrey, United Kingdom

[73] Assignee: The Stanley Works, New Britain, Conn.

[21] Appl. No.: 09/303,282

[22] Filed: Apr. 30, 1999

[51] Int. Cl.[6] ..... E05D 13/00

[52] U.S. Cl. ..... 49/425; 16/95 R; 16/97

[58] Field of Search ..... 49/409, 410, 425, 49/404; 16/92, 95 R, 97

[56] References Cited

U.S. PATENT DOCUMENTS

| | | | |
|---|---|---|---|
| 1,274,872 | 8/1918 | Gordon . | |
| 2,650,387 | 9/1953 | Foss . | |
| 2,807,058 | 9/1957 | Morgan . | |
| 2,971,228 | 2/1961 | Szabo . | |
| 3,798,839 | 3/1974 | Kaufman . | |
| 4,064,590 | 12/1977 | Smith . | |
| 4,112,622 | 9/1978 | Stewart | 16/97 X |
| 4,722,150 | 2/1988 | Jacobs et al. . | |
| 5,349,783 | 9/1994 | Jasperson et al. . | |

FOREIGN PATENT DOCUMENTS

| | | | |
|---|---|---|---|
| 144228 | 11/1951 | Australia | 16/97 |
| PCT/WO91/06736 | 5/1991 | France . | |
| 659625 | 10/1951 | United Kingdom . | |
| 1291463 | 10/1977 | United Kingdom . | |

*Primary Examiner*—Jerry Redman

[57] ABSTRACT

A wheeled top guide for rolling movement of a door along an inverted U-shaped track includes a housing for mounting on the door with an upwardly extending axle and a roller thereon for rolling engagement with one side wall of the trace. A vertically oriented torsion member is seated in the housing and has a vertically extending elongated torsion rod having its lower end fixed on the housing, a horizontally extending arm having one end secured to the upper end of the torsion rod and extending away from the first shaft, and an upwardly extending axle adjacent the other end of the arm. A second roller on this axle is in rolling engagement with the other side wall of the track and is spaced from the first roller. The second roller and arm are resiliently displaceable about the longitudinal axis of the torsion rod towards the housing for insertion of the rollers into the track, and the resulting torque in the torsion rod produces a force biasing the arm and thereby the second roller to maintain the rollers in firm rolling contact with the side walls of the track.

15 Claims, 7 Drawing Sheets

TOP GUIDE WITH SPRING LOADED WHEEL

BACKGROUND OF THE INVENTION

The present invention relates to sliding doors, and, more particularly, to a top guide for such sliding doors to facilitate stable placement and movement along the track in which they are inserted.

Various types of sliding doors are utilized for internal applications within residential and in some commercial structures. Although some sliding doors slide into a pocket formed in the wall of the building, frequently closets employ bypassing doors, i.e., a pair of doors which will slide in parallel tracks so that one side or the other of the door opening is clear to provide access to the closet. Such doors may comprise hollow core doors of wood or the like, or be an assembly of mirrors or other panels seated in metallic or wooden frames.

The tracks which are employed in such structures are generally extruded aluminum or roll formed sheet steel. For bypassing doors, the cross section of track is generally referred to as an inverted "E" in which there are two outside walls and a center wall to provide a pair of channels.

In Jasperson et al U.S. Pat. No. 5,349,783, there is illustrated a top guide utilizing a pair of wheels bearing on opposite walls of each of the channels of the track to provide stability of the door within the opening and desirable guided rolling action along the length of the track. The structure of this patent represents an effort to address the problem of variations in width of the track due to tolerances in forming the track and also the problems encountered as the rollers wear over extended periods of use. Although the structure shown in the Jasperson et al Patent has been beneficial, there has remained a need to provide an longer lived structure in which there is a desirable spring action to maintain the rollers in firm rolling engagement with the two walls of the track in which they operate.

Accordingly, it is an object of the present invention to provide a novel roller top guide for sliding doors in which there is continuing spring pressure to maintain the rollers in contact with the walls of the track.

It is also an object to provide such a roller top guide utilizing components which can be simply and economically fabricated from synthetic resin.

Another object is to provide such a roller top guide in which the components may be quickly assembled and which can be utilized in connection with both wooden doors and panel doors.

SUMMARY OF THE INVENTION

It has been found that the foregoing and related objects may be readily attained in a wheeled top guide for rolling movement of a door along an inverted U-shaped track and which includes a housing for mounting on the upper end of the door with an upwardly extending first axle on the housing, and a first roller on the axle for rotation thereabout in rolling engagement with one side wall of the track. A vertically oriented torsion member is seated in the housing and includes a vertically extending elongated torsion rod having its lower end fixedly seated on the housing, a horizontally extending arm having one end secured to the upper end of the torsion rod and extending away from the first axle, and an upwardly extending second axle adjacent the other end of the arm.

A second roller is seated on the second axle for rotation thereabout in rolling engagement with the other side wall of the track. The second roller is spaced from said first roller and the arm is resiliently displaceable about the longitudinal axis of the torsion rod from an initial position towards the housing for insertion of the rollers into the track. The resulting torque in the torsion rod produces a force biasing the arm and thereby the second roller towards its initial position to maintain the rollers in firm rolling contact with the side walls of the track Desirably, the housing includes a bracket rotatably seating the torsion rod adjacent its upper end. Preferably, the guide includes a second vertically oriented torsion member seated in the housing and a third roller on the axle thereof. The second and third rollers are spaced in the same direction from the first roller to bear upon the other wall of the track. The housing has a transverse axis and the horizontal arms of the torsion members diverge from the transverse axis.

The torsion rod is fabricated from synthetic resin, and the horizontal arm and second axle are integrally formed with the rod. Preferably, the horizontal arm is bifurcated at its end joined to the rod.

Desirably, the torsion rod has a horizontally disposed base element at the lower end securely seated in the housing, and the base element has a depending tab seated in a slot in the housing. The base element is integrally formed with the torsion rod.

DETAILED DESCRIPTION OF THE ILLUSTRATED EMBODIMENT

Figure 1:
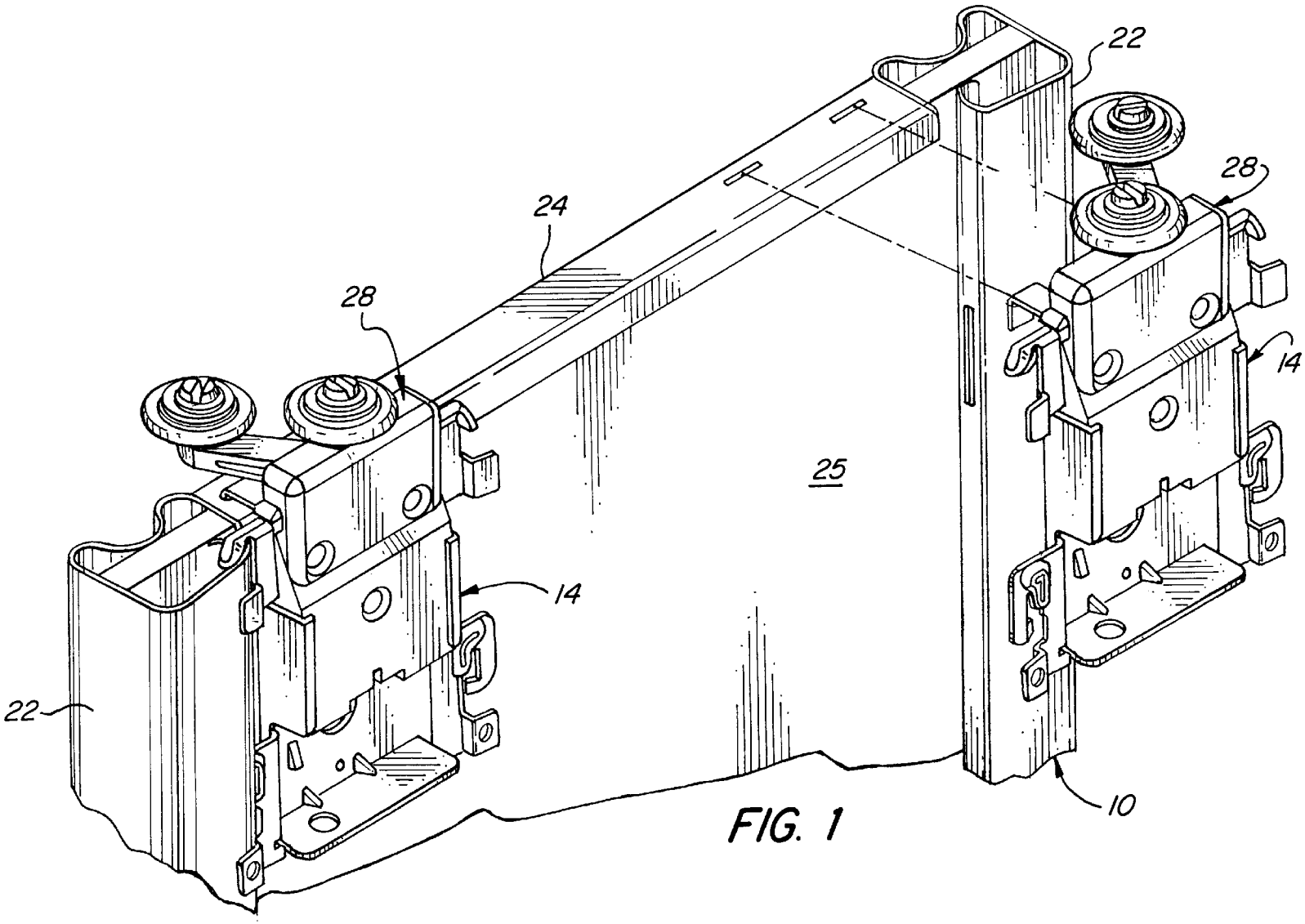
FIG. 1 is a fragmentary and partially exploded view of a door assembly employing a roller top guide embodying the present invention.

Turning first to FIG. 1 of the attached drawings, therein illustrated fragmentarily is a panel door generally designated by the numeral 10 having corner connectors generally designated by the numeral 14 in which are seated roller top guides embodying the present invention and generally designated by the numeral 28.

Figure 7:
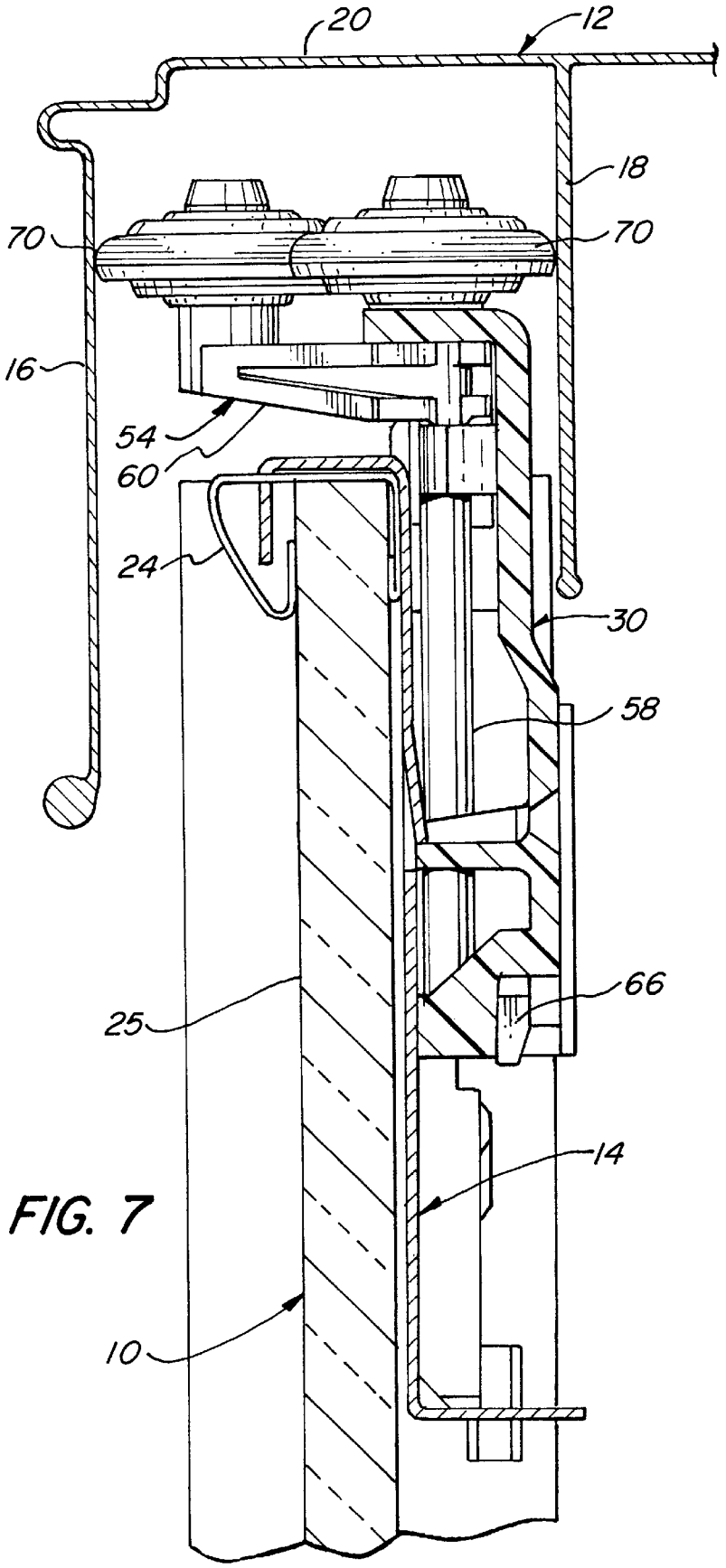
FIG. 7 is a fragmentary end elevational view of the door seen in FIG. 1 seated in a track and drawn to an enlarged scale.

As seen in FIG. 7, the roller top guides 28 extend within a U-shaped track portion provided by the dual track construction of generally inverted E-shaped configuration and generally designated by the numeral 12. The track 12 has side walls 16, a center wall 18 and a transversely extending top wall or web 20.

The panel door assembly illustrated in FIG. 1 is generally comprised of stiles 22 and rails 24 which receive the panel 25 in the channels thereof, and the stiles and rails 22,24 are joined by the corner connectors 14.

Figure 2:
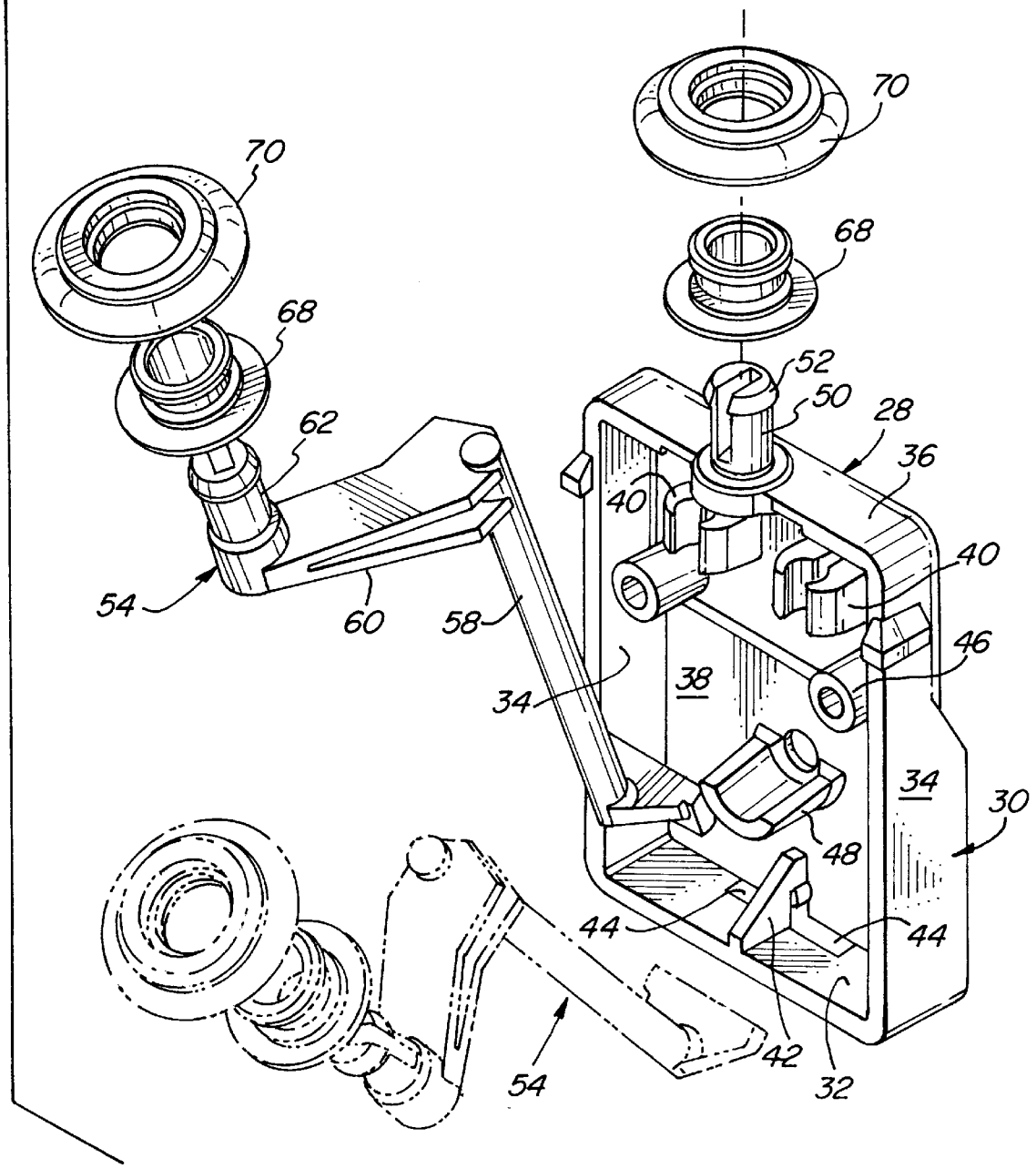
FIG. 2 is an exploded view of the top guide drawn to an enlarged scale showing the torsion member/roller assembly in solid line in one orientation and a second torsion member/roller assembly in phantom line to provide a three-roller top guide as illustrated in FIG. 3.
Figure 3:
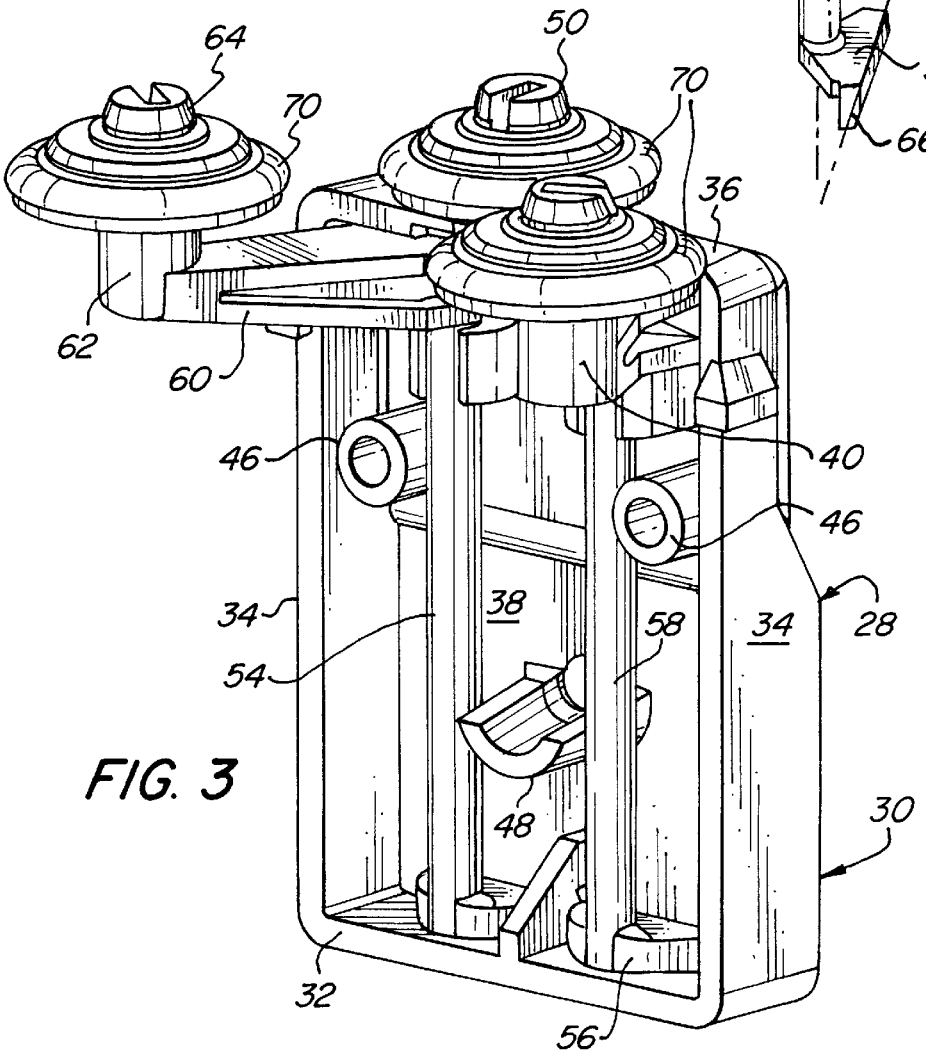
FIG. 3 is an elevational view of an embodiment of the present invention in which there are three roller, two of which are provided on torsion members.

Turning next to FIGS. 2 and 3, the roller top guide 28 is comprised of a housing generally designated by the numeral 30 and having a bottom wall 32, side walls 34, top wall 36 and a panel wall 38. Adjacent the top wall 36 there is provided a pair of brackets or clips 40 on the panel wall 38. Therebelow is a pair of cylindrical bosses 46 to seat fasteners (not shown) for engagement of the housing 30 to a wooden door (not shown), and centered therebelow is a semicircular boss 48 which functions as a stop in connection with the metal corner connector 14.

Projecting upwardly from the top wall 36 is an axle 50 with a collar 52 about its upper end. At the center of the bottom wall 32 is an upstanding center wall 42, and the bottom wall 32 is provided with slots 44 adjacent the intersection of the center wall 42 with the panel wall 38.

Seated on the axle 50 are a wheel bearing 68 and a roller 70, and the collar 52 over which they snap to assemble them retains them thereon.

Figure 4:
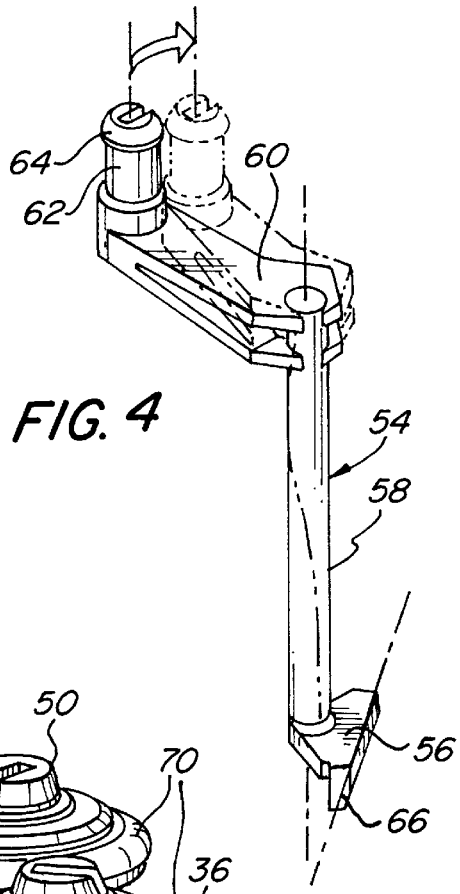
FIG. 4 is a perspective view of a torsion member employed in the assembly shown in solid line in its initial or rest position, and in phantom line in a twisted or partially rotated position.

As best seen in FIGS. 2 and 4, the torsion member generally designated by the numeral 54 includes a base 56, an elongated rod 58, a bifurcated arm 60 and an axle 62 having a collar 64 adjacent its upper end. The base 56 has a depending tab 66 which will seat in the slot 44 in the bottom wall 32. As seen in FIG. 2 and more clearly seen in other figures and drawings, the bifurcated arm 60 extends at an included angle of about 45° with a line perpendicular to the panel wall 38. Seated on the axle 62 are a wheel bearing 68 and a roller 70, and the collar 64 retains them thereon.

Shown in phantom line in FIG. 2 is a second torsion member 54 which is oppositely handed, i.e., extends in the opposite direction also at an included angle of about 45°. An assembly with two torsion members is seen in FIG. 3 wherein a pair of torsion members 54 is seated in the brackets or clips 40 with the tabs 66 seated in the slots 44 so as to securely anchor the bases of the torsion members 54 against rotation while the upper end portions of the torsion rods are free to rotate within the brackets 40.

As indicated in FIG. 4, displacing the outer end of the arm 60 from the full line position to the phantom position by 15° will produce torsion in the rod 58 as indicated by the phantom line extending therealong.

Figure 6:
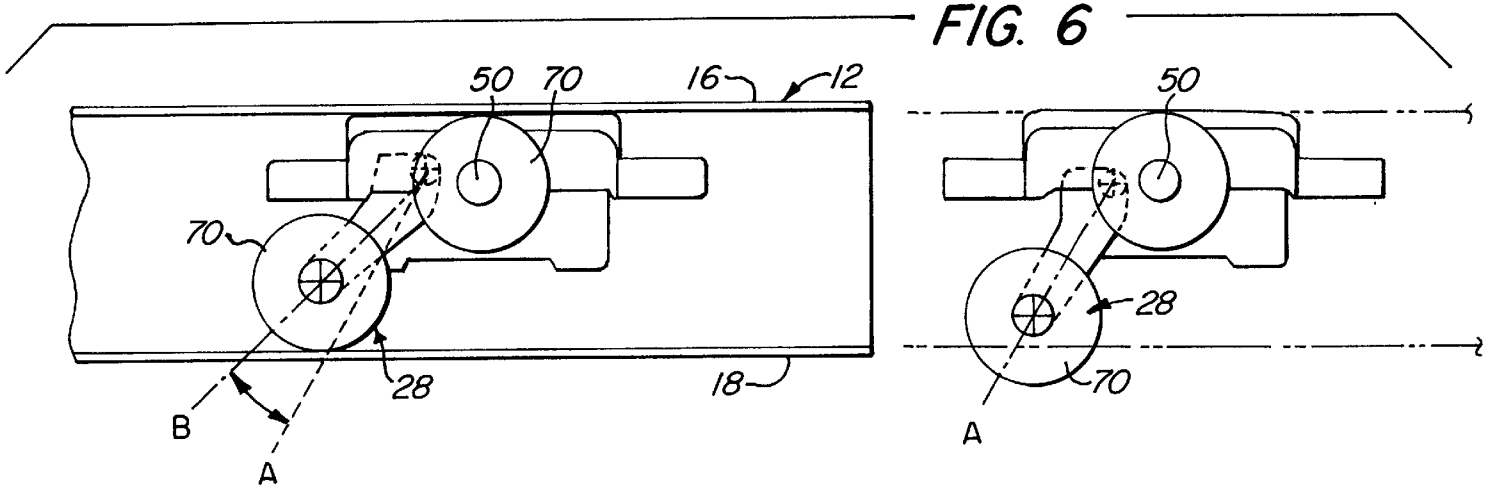
FIG. 6 is a partially diagrammatic view showing in the phantom line portion of the track, the position in which the roller on the torsion member would be oriented if the arm were not pivoted about the torsion rod, and showing in solid line the deflection of the roller from the at rest position shown in the phantom line portion.

Thus, as partially diagrammatically illustrated in FIG. 6, in which the undeflected position of the roller 70 and arm 60 is designated position "A", the roller top guide 28 would not fit within the track 12. Deflection of the arm 60 and roller 70 to the position "B" enables the roller top guide 28 to be inserted into the track 12 and this produces torsional distortion along the length of the rod 58. When the roller top guide 28 with the deflected arm 60 is seated within the track 12, the torque or torsional force in the rod 58 now produces a biasing pressure of the roller 70 against the center wall 18, while the fixed roller 70 on the axle 50 bears against the side wall 16. This biasing pressure causes the roller top guide 28 to roll smoothly along the walls 16,18 of the track 12.

Figure 5:
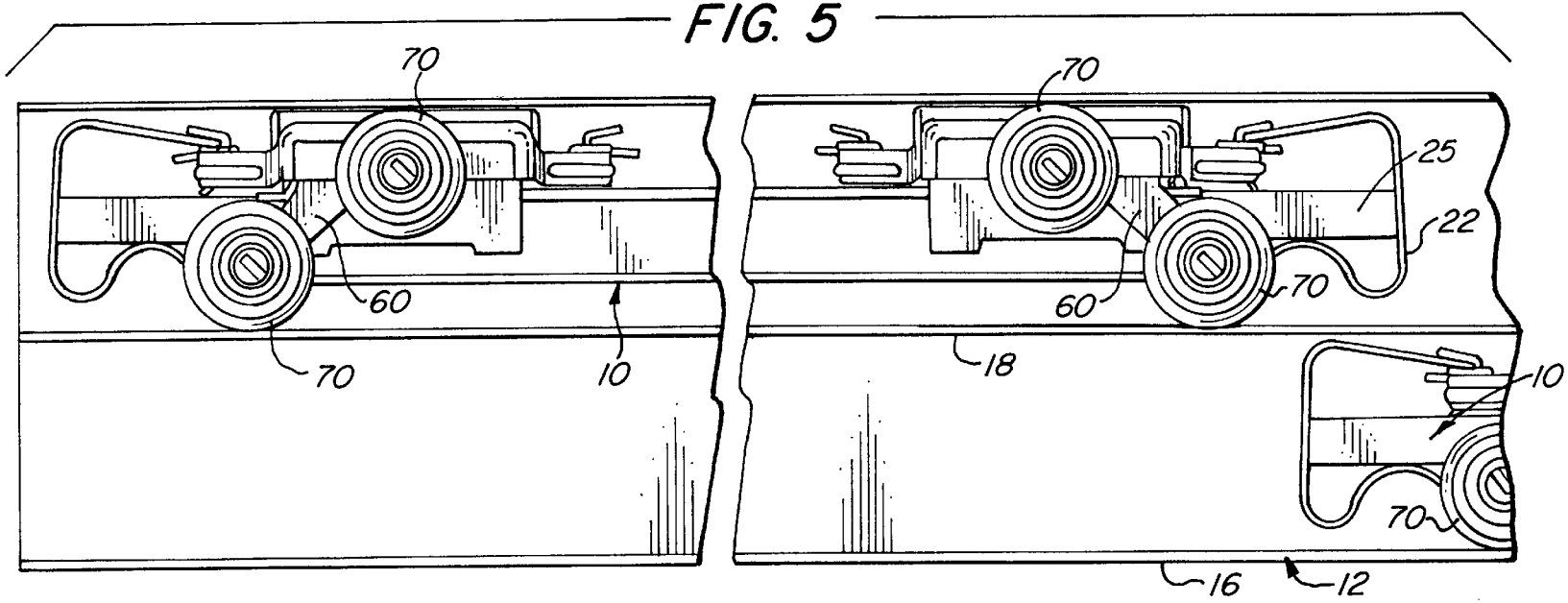
FIG. 5 is a plan view of the door assembly of FIG. 1 with a fragmentary portion of a second door shown in the adjacent channel of the E-track.

In the typical by-passing door assembly seen in FIG. 5, two doors 10 are disposed in the two channels of the track 12, and the rollers 70 on the torsion member 54 of each are biased against the center wall 18 to maintain good rolling contact and positioning of the doors 10.

Figure 8:
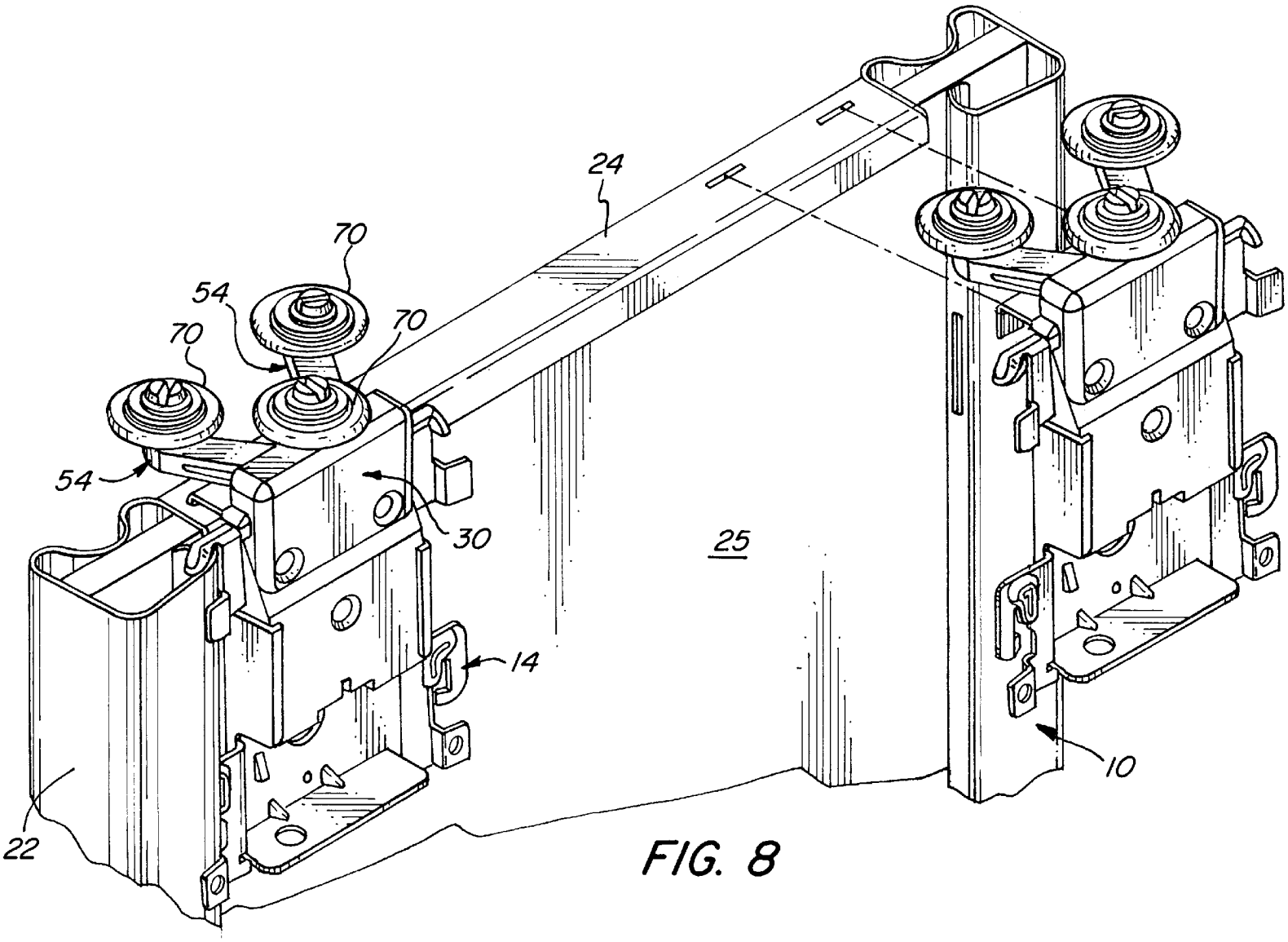
FIG. 8 is a fragmentary perspective view of a door assembly with a pair of three-roller top guides one of which is disassembled from the door.
Figure 10:
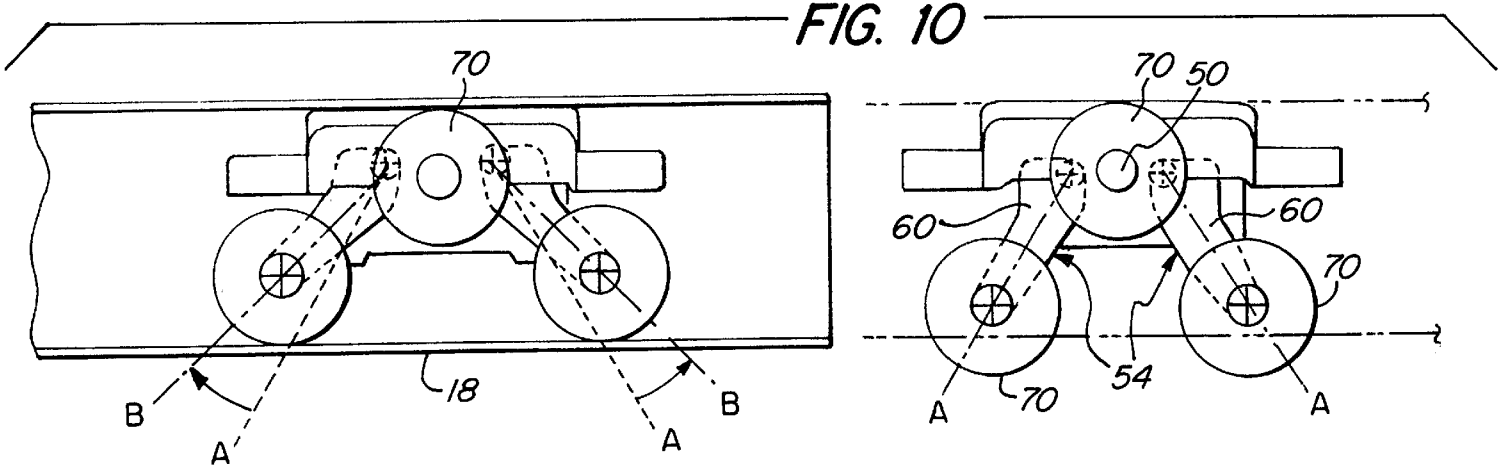
FIG. 10 is a view similar to FIG. 6 illustrating the amount of angular displacement of the rollers and arms of the torsion members.
Figure 9:
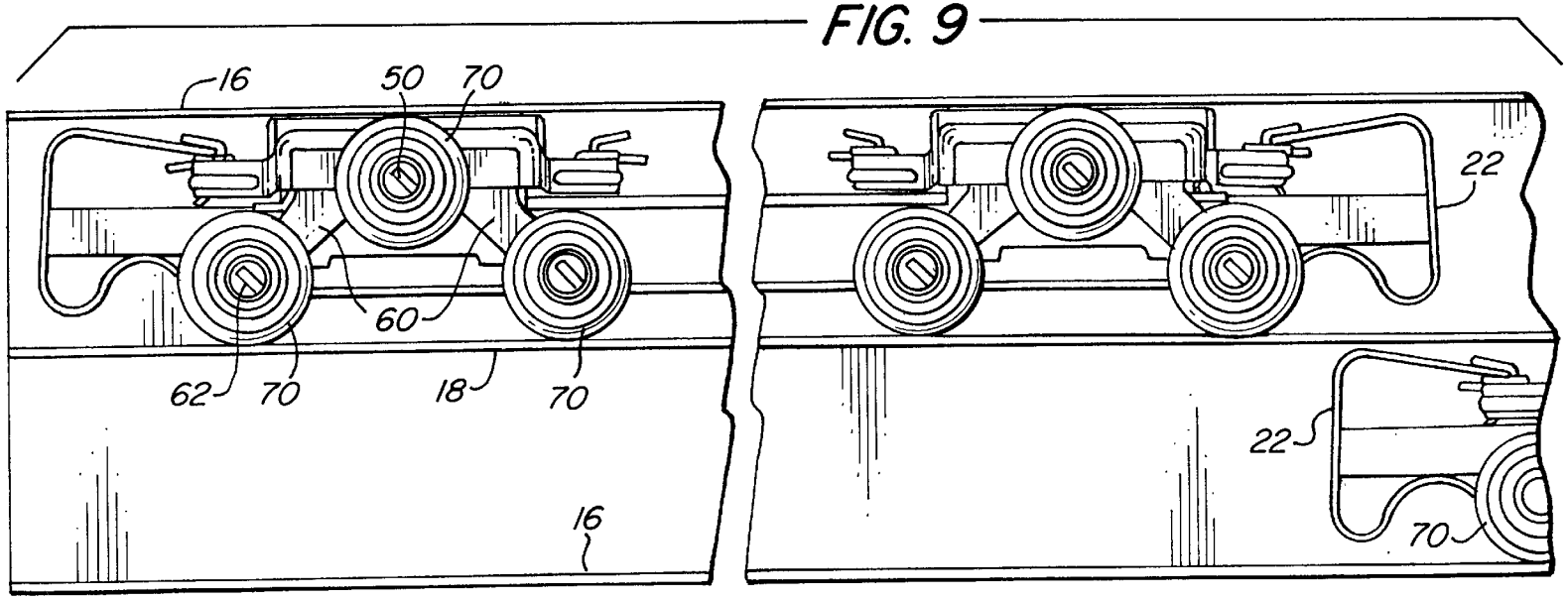
FIG. 9 is a view similar to FIG. 5 showing a pair of three-roller top guides of the embodiment of FIG. 3 disposed within one of the channels of the track ans a second fragmentary portion of a second door in the adjacent channel.

In FIGS. 3 and 8, there is illustrated a three-roller embodiment of the roller top guide of the present invention. A pair of oppositely handed or angled torsion members 54 is employed to provide a pair of torsion biased rollers 70 bearing against the center wall 18 of the track 12 as shown in FIGS. 9 and 10. As diagrammatically illustrated in FIG. 10, the oppositely angled arms 60 of the torsion member 54 are deflected oppositely to reduce the spacing between their axles and the center line of the housing 30 to enable insertion of the top guide 28 into the channels of the track 10. When the initial deflecting force is removed, the arms 60 are biased towards their undeflected position seen in the right hand portion of the figure to seat firmly against the center wall 18. The amount of continuing deflection is illustrated by the included angle between the lines "A" and "B".

As will be readily appreciated, the retained torsional loading in the torsion member will apply a continuing biasing force or spring pressure acting through the roller against the wall of the track. This will keep the door firmly retained in position within the track to avoid rattling and will provide smooth rolling action as the door is moved along the track. Obviously, more spring force is provided by a pair of tension members as shown in FIGS. 8 and 9 than would be provided by a single member as shown in FIGS. 4 and 5.

The key element of the assembly is obviously the torsion member itself which is integrally molded to provide a high strength part. The angular orientation in the length of the arm will depend upon the track width in which the top guide is to operate. It is generally desirable to achieve a deflection of about 10° to 15° in the spring loaded position seated in the track and this will normally require a deflection of about 25° to 30° to effect insertion into the track. In practice, it has been found that utilizing a vertical length of about 40–60 millimeters for the rod portion of the torsion member with a diameter of about 4–5 millimeters will provide a desirable level of torsional action. Recent tests have indicated some improvement in developing the desired torsion by tapering the rod from its base to a reduced diameter adjacent the clip with the reduction being about 10%. The portion from the clip to the upper end is of uniform diameter. The arm length for the torsion member is generally in the range of 20–35 millimeters center to center from the rod to the axle at the end of the arm. The use of a bifurcated arm portion increases the strength of the connection between the arm portion and the rod portion.

In the illustrated embodiment, it can be seen that the foot and the tab on the torsion member firmly seat in the base of housing so as to anchor the bottom of the rod against any rotation while the clip or bracket adjacent the top of the rod to rotate therewithin.

Various resins can be utilized to fabricate the elements of the top guide. A high strength acetyl resin is desirable for fabricating the housing and torsion members. The tire or roller is desirably in elastomeric material and the bearing element for the roller assembly is desirably a low friction material such as a nylon 66.

In assembling the structure, the base or foot and tab are first inserted into position in the base of the bottom wall of the housing and then the torsion member can be pivoted upwardly to stamp it into the clip or brackets of the housing. The bearing and roller can the be snap fit over the collar on the axle.

The illustrated embodiment of the top guide can be utilized in combination with a corner bracket conventionally employed for mirror and other panel doors. Alternatively, for a wooden door, the housing may be secured directly to the door by fasteners inserted through the circular bosses which are illustrated in the several embodiments.

Thus, it can be seen that the roller top guide of the present invention may be readily fabricated and assembled to provide a long lived element in which there is a constant biasing pressure maintaining the door firmly in position within the track. The components are few in numbers so as to minimize costs while allowing optimum choice of materials to improve life.

Having thus described the invention, what is claimed is:

1. A wheeled top guide for rolling movement of a door along an inverted U-shaped track comprising:

(a) a housing for mounting on an upper end of the door;

(b) an upwardly extending first axle on said housing;

(c) a first roller on said first axle for rotation thereabout in rolling engagement with one side wall of the track;

(d) a vertically oriented torsion member seated in said housing and including (i) a vertically extending elongated torsion rod having its lower end fixedly seated on said housing; (ii) a horizontally extending arm having one end secured to an upper end of said torsion rod and extending away from said first shaft; and (iii) an upwardly extending second axle adjacent the other end of said arm; and (e) a second roller on said second axle for rotation thereabout in rolling engagement with the other side wall of the track, said second roller being spaced from said first roller, said second roller and arm being resiliently displaceable about the longitudinal axis of said torsion rod towards said housing for insertion of said rollers into the track, the resulting torque in said torsion rod producing a force biasing said arm and thereby said second roller towards its initial position to increase the spacing between, and maintain said rollers in firm rolling contact with the side walls of the track.

2. The top guide in accordance with claim 1 wherein said housing includes a bracket rotatably seating said torsion rod adjacent its upper end.

3. The top guide in accordance with claim 1 wherein there are included a second vertically oriented torsion member seated in said housing and a third roller on the axle thereof, said second and third rollers being spaced in the same direction from said first roller to bear upon the other wall of the track.

4. The top guide in accordance with claim 3 wherein said housing has a transverse axis and said horizontal arms of said torsion members diverge from said transverse axis.

5. The top guide in accordance with claim 1 wherein said torsion rod is fabricated from synthetic resin.

6. The top guide in accordance with claim 1 wherein said horizontal arm and second shaft are integrally formed.

7. The top guide in accordance with claim 1 wherein said horizontal arm is bifurcated at its one end.

8. The top guide in accordance with claim 1 wherein said torsion rod has a horizontally disposed base element at said lower end securely seated in said housing.

9. The top guide in accordance with claim 8 wherein said base element has a depending tab scaled in a slot in said housing.

10. The top guide in accordance with claim 8 wherein said base element and said torsion rod are integrally formed.

11. A wheeled top guide for rolling movement of a door along an inverted U-shaped track comprising:

(a) a housing for mounting on an upper end of the door;

(b) an upwardly extending first axle on said housing;

(c) a first roller on said first axle for rotation thereabout in rolling engagement with one side wall of the track;

(d) a vertically oriented torsion member seated in said housing and including (i) a vertically extending elongated torsion rod having a bare element at its lower end fixedly seated on said housing, said housing having a bracket seating the upper end portion of said rod; (ii) a horizontally extending arm having one end secured to an upper end of said torsion rod and extending away from said first shaft; and (iii) an upwardly extending second axle adjacent the other end of said arm, said torsion member being integrally formed from synthetic resin; and (e) a second roller on said second axle for rotation thereabout in rolling engagement with the other side wall of the track, said second roller being spaced from said first roller, said second roller and arm being resiliently displaceable about the longitudinal axis of said torsion rod towards said housing for insertion of said rollers into the track, the resulting torque in said torsion rod producing a force biasing said arm and thereby said second roller towards its initial position to increase the spacing between, and maintain said rollers in firm rolling contact with the side walls of the track.

12. The top guide in accordance with claim 11 wherein said horizontal arm is bifurcated at its one end.

13. The top guide in accordance with claim 11 wherein there are included a second vertically oriented torsion member seated in said housing and a third roller on the axle thereof, said second and third rollers being spaced in the same direction from said first roller to bear upon the other wall of the track.

14. The top guide in accordance with claim 13 wherein said housing has a transverse axis and said horizontal arms of said torsion members diverge from said transverse axis.

15. The top guide in accordance with claim 11 wherein said base element has a depending tab scaled in a slot in said housing.

* * * * *